United States Patent [19]

Jeter

[11] 4,009,613

[45] Mar. 1, 1977

[54] APPARATUS AND METHOD FOR INDICATING AT THE SURFACE THE MEASUREMENT OF A DOWNHOLE CONDITION

[76] Inventor: John D. Jeter, 201 W. Clara, Iowa Park, Tex. 76367

[22] Filed: July 24, 1975

[21] Appl. No.: 598,708

Related U.S. Application Data

[62] Division of Ser. No. 409,176, Oct. 24, 1973, Pat. No. 3,908,453.

[52] U.S. Cl. ..... 73/155; 340/18 NC

[51] Int. Cl.[2] ..... F21B 47/06

[58] Field of Search ..... 73/151, 152, 155; 340/18 P, 18 LD, 18 NC

[56] References Cited

UNITED STATES PATENTS

| | | | |
|---|---|---|---|
| 2,588,717 | 3/1952 | Goodwin | 73/152 |
| 2,700,131 | 1/1955 | Otis et al. | 73/151 UX |
| 2,759,143 | 8/1956 | Arps | 73/152 |
| 3,302,457 | 2/1967 | Mayes | 73/152 |
| 3,805,606 | 4/1974 | Stelzer et al. | 73/152 |

*Primary Examiner*—Jerry W. Myracle

[57] ABSTRACT

A sensor carried by a pipe string measures a downhole condition. After a delay, a signal is transmitted to the surface. The delay is proportional to the measurement and can be measured in time, in revolutions of the pipe string, or in the volume of fluid pumped during the delay.

21 Claims, 18 Drawing Figures

FIG. 7
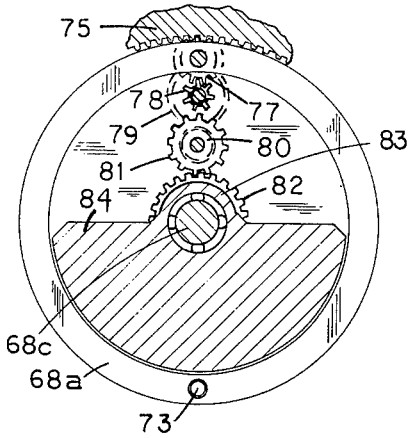
FIG. 9
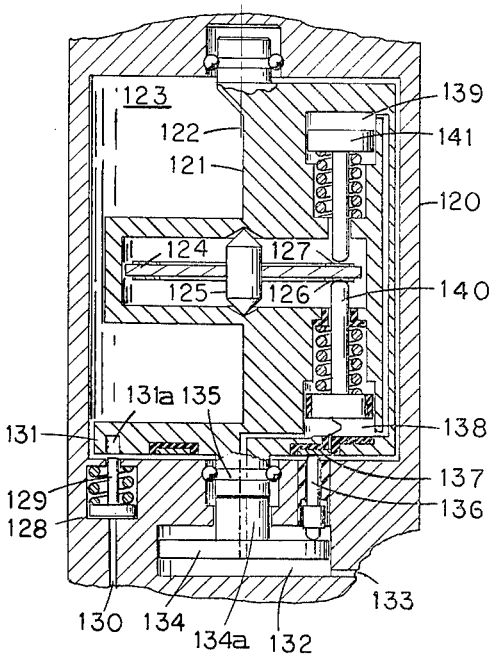
FIG. 8
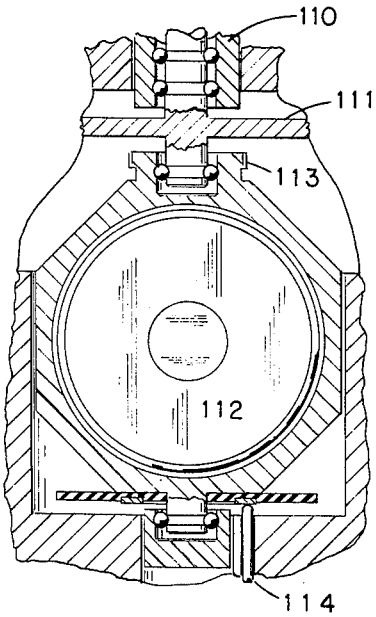
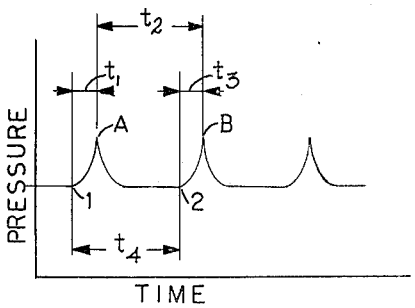
FIG. 12

APPARATUS AND METHOD FOR INDICATING AT THE SURFACE THE MEASUREMENT OF A DOWNHOLE CONDITION

This is a division of prior application Ser. No. 409,176 filed Oct, 24, 1973, now U.S. Pat. No. 3,908,453.

This invention relates to an apparatus for and a method of indicating at the surface the measurement of one or more downhole conditions in a well bore.

In rotary drilling operations, it is often desirable, and sometimes necessary, to measure one or more downhole conditions from time to time. For example, it is quite common to check the inclination of the well bore frequently as the drilling progresses. This may be coupled with measuring the compass or azimuthal direction that the well bore is taking. Both the inclination and the compass direction of a well bore are frequently checked during directional drilling operations. There are other conditions that an operator would be interested in knowing, such as the temperature adjacent the bottom of the hole, if such information could be obtained quickly and easily and without causing undue delay in the drilling operation.

It is an object of this invention to provide an improved method of and apparatus for indicating at the surface the measurement of a downhole condition.

It is another object of this invention to provide a method of and apparatus for measuring a downhole condition from the surface by measuring a surface measurable quantity, such as the passage of time, the number of rotations of the drill string, or the volume of fluid pumped down the drill pipe.

It is another object of this invention to provide a method of and apparatus for indicating at the surface the measurement of a downhole condition by the delay that occurs between the actuation of the measuring and signaling apparatus and the receipt of a signal at the surface.

It is another object of this invention to provide such a method and apparatus that indicates at the surface the measurement of one or more downhole conditions by measuring a surface measurable condition, such as the passage of time, revolutions of the pipe string, or volume of fluid pumped before a signal from the measuring apparatus reaches the surface.

It is another object of this invention to provide such a method and apparatus that includes a timer that delays the sending of a signal to the surface for a period of time that is proportional to the measurement of the downhole condition.

It is a further object of this invention to provide a method of and apparatus for providing a pressure pulse in the fluid flowing through a drill string when a signal having a characteristic that changes in magnitude at a preselected rate with respect to a surface measurable quantity, such as time, drill pipe rotation, or volume of fluid pumped, reaches a pedetermined relationship with a signal with a characteristic having a magnitude that is proportional to the measurement of a downhole condition thereby indicating at the surface the measurement of such condition.

These and other objects, advantages, and features of this invention will be apparent to those skilled in the art from a consideration of this specification, including the attached drawings and appended claims.

Figure 5A:
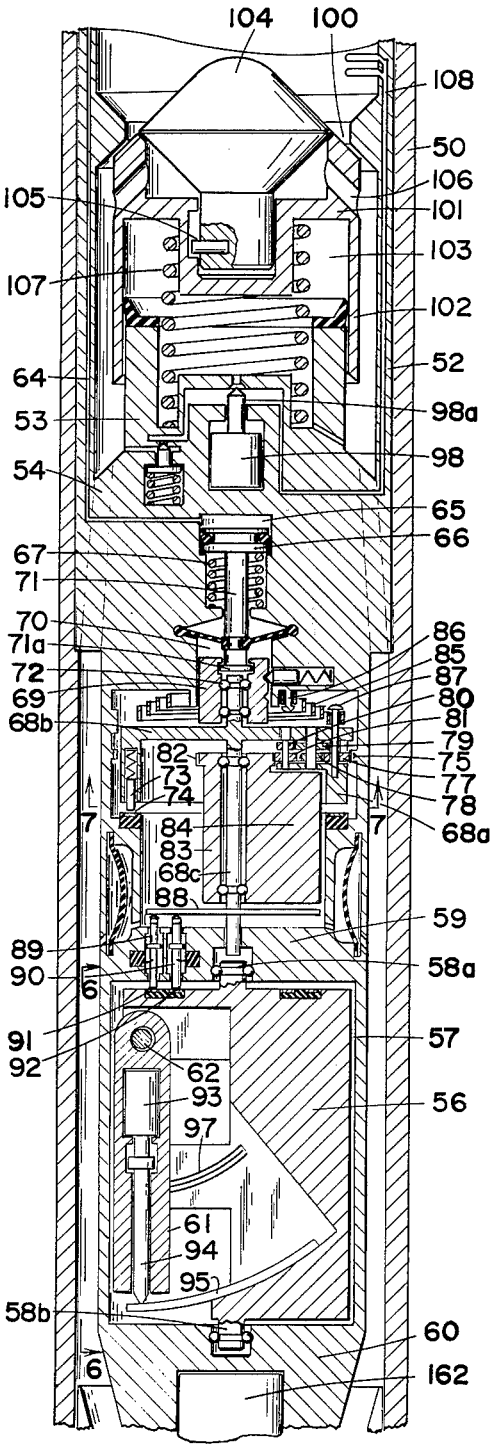
Figure 5B:
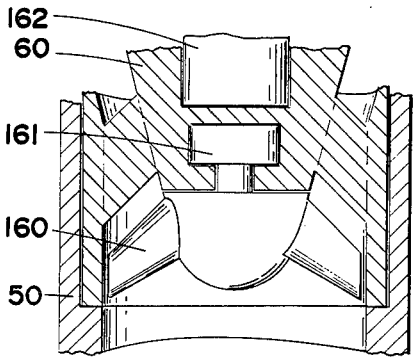
Figure 6:
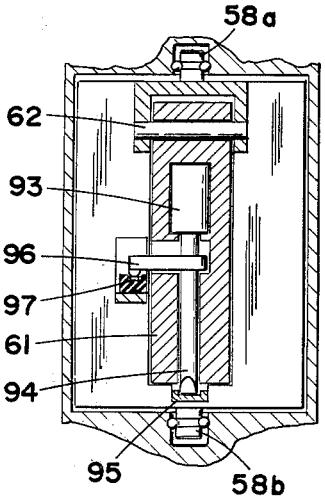

FIGS. *5a* and *5b* are vertical sectional views through an embodiment of the invention designed to measure the inclination of a well bore and to allow this measurement to be determined at the surface by the number of times the drill pipe is rotated before a pressure signal is received at the surface;

FIG. 6 is a view looking along line 6—6 of FIG. 5 with the wall of the instrument housing removed;

FIG. 7 is a sectional view taken along line 7—7 of FIG. 5 with the eccentric weight pivoted 180° to expose the gear train;

FIG. 8 is a sectional view through a portion of an alternate embodiment of the apparatus of FIG. *5a;*

Figure 10:
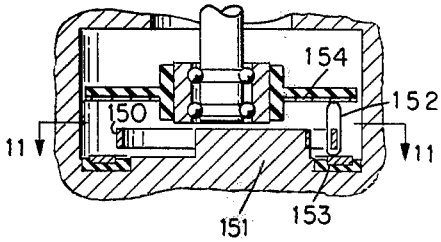
Figure 2:
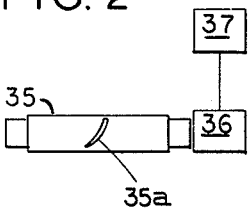
FIG. 2 is a schematic drawing of apparatus for use with the apparatus of FIG. 1 when the volume of fluid pumped through the pipe string is measured to determine the measurement of a downhole condition.
Figure 11:
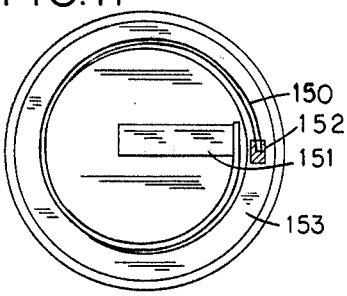
Figure 13:
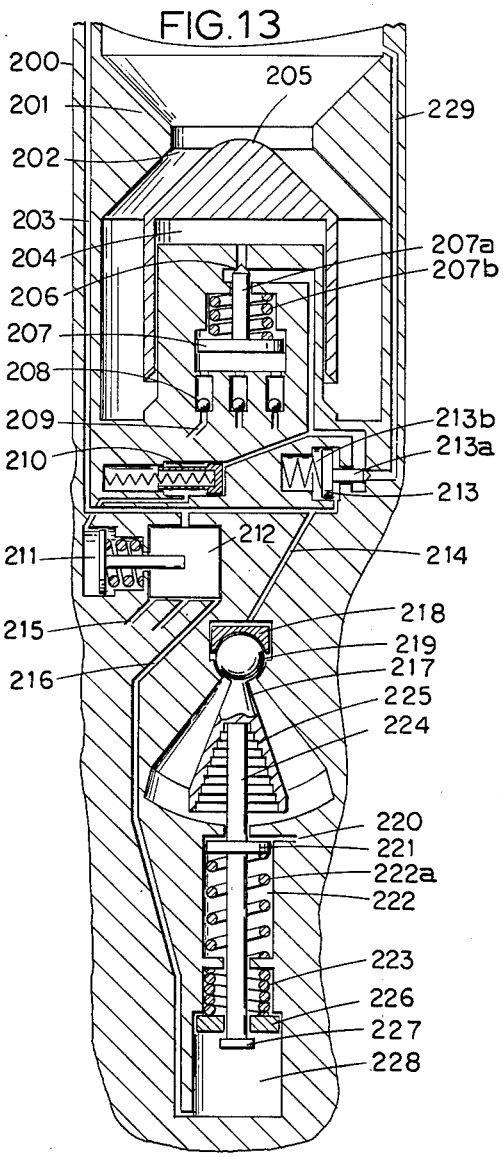
Figure 15:
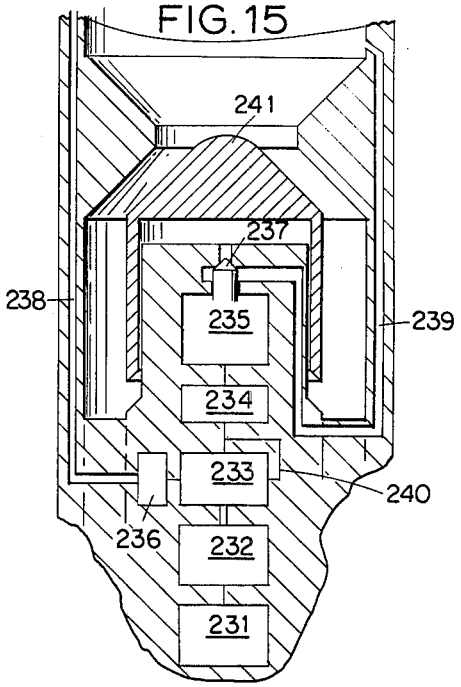
Figure 16:
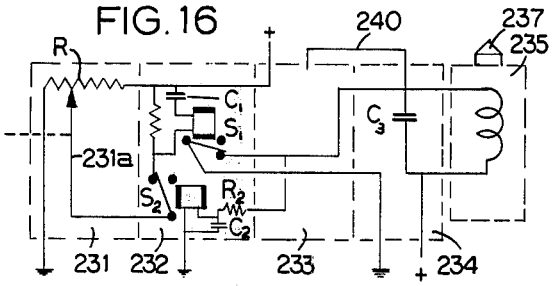
Figure 14:
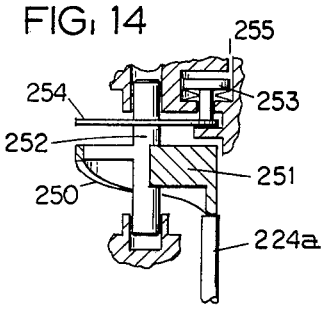
Figure 17:
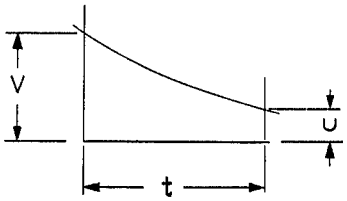

FIG. 9 is a sectional view through a sensor that can be employed for measuring the compass or azimuthal direction of a well bore;

FIG. 10 is a sectional view through a termperature sensing device for use with the apparatus of this invention;

FIG. 11 is a view taken along line 11—11 of FIG. 10;

FIG. 12 is a graph of circulating pressure versus time;

FIG. 13 is a sectional view of an alternate embodiment of the apparatus of this invention designed for indicating at the surface the measurement of a plurality of downhole conditions with the apparatus to indicate inclination of a well bore being shown;

FIG. 14 is a sectional view of apparatus for use with the apparatus of FIG. 13 for indicating compass direction of an inclined well bore;

FIG. 15 is a sectional view of surface signaling apparatus and a schematic diagram of an electrical circuit for actuating the signaling apparatus in accordance with the method and apparatus of this invention;

FIG. 16 is a more detailed circuit diagram of the circuit shown schematically in FIG. 15; and FIG. 17 is a graph of the decay of voltage versus time in a R-C circuit that provides the time delay of the embodiment of FIG. 15.

The apparatus shown in the drawings is designed to be carried by a pipe string extending into a well bore. Only the portion of the pipe string in which the apparatus is located is shown. The position of the apparatus in the pipe string will be determined by the operator. In drilling operations, it usually will be located adjacent the drill bit.

The apparatus of this invention can be actuated in any desired manner. The embodiments shown in the drawings are designed to be actuated by a fluid pressure signal. Such a pressure signal can be provided using the apparatus and method described in my copendng application, Ser. No. 409,176, filed Oct. 24, 1973 now U.S. Pat. No. 3,908,453. The apparatus described in U.S. Pat. No. 2,924,432, which issued to Arps et al. on Feb. 9, 1960, could be used to supply an electrical actuating signal.

In accordance with this invention, the downhole condition is measured and a signal is sent to the surface after a delay that is proportional to the measurement. In the embodiments shown in FIGS. 1–12, a first signal is provided having a value or a characteristic that varies from a known value at a predetermined rate. This signal is compared to a second signal having a value or characteristic that is proportional to the measured condition. Then the value of the first signal reaches a preselected relationship, a signal is sent to the surface. The value of the first signal may vary with respect to time, revolutions of the pipe string, or volume of fluid pumped, all of which can be measured at the surface to indicate the measurement of the downhole conditon.

Figure 1:
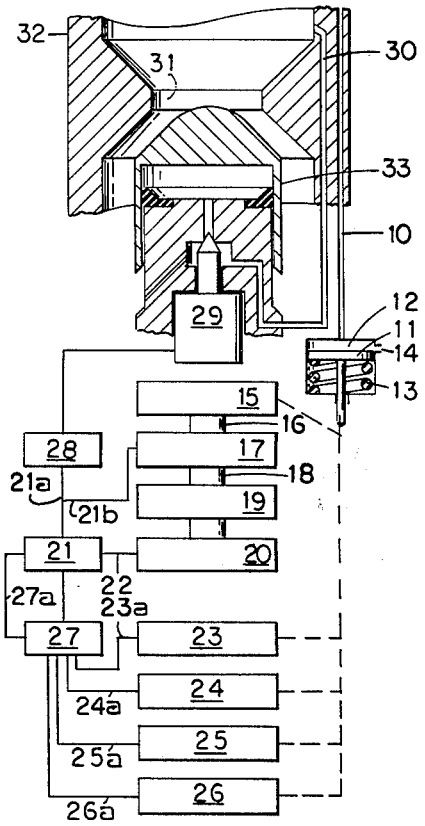
FIG. 1 is a schematic drawing of the preferred embodiment of the apparatus of this invention wherein the measurement of the downhole condition is related to elapsed time.

Referring now to the embodiment shown in FIG. 1, the actuating fluid pressure is supplied to the apparatus through conduit 10. The pressure of this fluid is sufficiently greater than ambient pressure to force piston 11 in cylinder 12 to move downwardly against spring 13 until port 14 is uncovered. The port restricts the flow from cylinder 12 to maintain sufficient pressure in the cylinder to hold piston 11 below the port.

This movement of piston 11 actuates timer 15, which is designed to rotate output shaft 16 at a preselected speed. As long as the piston is held in the down position as shown, the timer, which can be a chronometer or any convenient instrument that will provide power to rotate the shaft at a known rate of speed, will continue to run. Clutch 17 connects shaft 16 with shaft 18. The clutch is designed to connect the two shafts together unless supplied with a releasing signal, which will be described below. Block 19 represents a coil spring that provides a resilient force to resist the rotation of shaft 18 in one direction. Rotation of the shaft in this direction will store energy in the spring and when the shaft is released, the spring will return the shaft against a stop back to a preselected original position.

In this embodiment, the first signal described above is electrical. Variable resistor 20 is connected in a circuit that provides an output signal to comparator 21 through conductor 22. The resistor and circuit are designed to provide a signal that has a characteristic, such as voltage or current, that varies in a predetermined manner as the movable contact of the variable resistor is moved at a known rate of speed. The movable contact is moved by shaft 18. When clutch 17 is released, the spring will move shaft 18 into engagement with a stop and the circuit will provide a signal having a characteristic of a predetermined known value. The rate of change of this characteristic of the output signal per unit of time is also known from the design of the circuit. Thus, a signal is provided to comparator 21 having a value or characteristic that changes from a predetermined known value or magnitude at a predetermined rate so that at any given time after timer 15 begins to move the movable contact through shaft 18, the magnitude of the variable characteristic of the output signal is known.

The method and apparatus of this invention is to indicate at the surface the measurement of one or more downhole conditions. In the embodiment shown, four sensors, 23, 24, 25, and 26, for measuring four downhole conditions, are shown. Each sensor is arranged to provide an electrical signal similar to the first having a characteristic with a magnitude that is proportional to the measurement of a selected downhole condition. The output signals from such sensors are supplied to selector switch 27 through conductors **23*a*–26*a*. The common terminal of the switch is connected to comparator 21 through line 27*a***.

In operation, when it is desired to measure the selected downhole conditions, a pressure signal will be supplied to the apparatus through line 10 that will actuate though of the measuring devices or sensors. Some of these sensors will probably require that rotation of the drill pipe be stopped for a period of time to allow the sensor to read or measure the downhole condition. For example, the sensor measuring inclination may use some type of pendulum which will require that the movement of the drill pipe be stopped to allow it to assume a vertical position. After the period of quiescence, the sensors preferably are locked in the position they assumed during this period so that they will be able to supply the measurement later even through the drill pipe may not remain quiescent during the actual readout operation.

Assume that sensor 23 has measured the inclination of the well bore and it is providing a signal with a characteristic having a magnitude proportionate to the inclination measured. Stepper switch 27 connects output line **23*a* to comparator 21 through line 27*a*. As this is occurring, timer 15 is moving the movable contact of variable resistor 20 at a predetermined speed to provide the comparator with the first signal described above. When the selected characteristic of the signal from variable resistor 20 reaches some proportional amount of the characteristic of the signal output of sensor 23*a*, for example, as when a characteristic of the signals, such as their voltage, become equal in magnitude, then comparator 21 will emit a signal. This signal is transmitted to clutch 17 through line 21*b* and releases the clutch to disconnect shafts 16 and 18. The signal also energizes relay 28 through line 21*a*. The relay actuates solenoid 29, which opens passageway 30 allowing pressure upstream of orifice 31 in drill pipe 32 to act against piston 33 moving it upwardly into orifice 31. This creates a pressure pulse in the fluid in the drill string that can be detected at the surface. Thus, by timing the period between the actuation of this apparatus and when the signal reaches the surface, the value of the variable characteristic of the output signal from the inclinometer (sensor 23**) can be determined. This value is proportional to the inclination of the well bore, and knowing the relationship of inclination to the magnitude of such characteristic, the inclination can be determined.

The output signal from comparator 21 may be in the nature of a pulse of relatively short duration. Such a pulse would probably not hold relay 28 actuated long enough to create the signal pulse. Therefore, relay 28 is of the time-delay type that is closed by the pulse and will remain closed for a period of time that is long enough to cause the pressure pulse to be transmitted to the surface.

As stated above, information about several downhole conditions may be desired. In the embodiment shown, four sensors are shown. The signal produced by comparator 21 through conductor **27*a* steps switch 27 to a second position. This connects the output signal of sensor 24 to the comparator. The comparator signal, as explained above, also releases clutch 17 and allows spring 19 to return the movable contact of variable resistor 20 to its original position. Thus, when switch 27 is stepped to its second position, the timer will be starting again to move the movable contact of variable resistor 20 from its starting point providing again this first signal that has a characteristic that varies from a known value at a predetermined rate. This signal is again supplied to the comparator so that the time it takes this signal to reach a preselected proportional amount of the characteristic of the signal from instrument 24 will be indicative of the reading of the sensor. When comparator 21 supplies the signal indicating the preselected relationship of the characteristics, another pressure pulse will be sent to the surface, switch 27 will be stepped again, and clutch 17 will release shaft 18 to be returned again to its starting position by coil spring 19.**

For checking purposes, one or more of instruments 23–26 could be used to provide a signal not related to a downhole condition but having a characteristic of a predetermined magnitude to provide a surface check of the operation of the equipment. Also, it may be desirable to start measuring time from the receipt of a pressure pulse at the surface. This would eliminate possible errors due to the time required to produce the pressure pulse and the time required for the pulse to reach the surface. For example, sensor 23 could be preset to provide a signal having a fixed characteristic to give an indexing pulse, such as pulse A of FIG. 12. The pulse was created at point 1 and took $t_1$ to reach the surface. If the next pulse indicates inclination, then $t_2$ is the surface indication. The pulse was created at point 2 and took $t_3$ to reach the surface. Since travel time $t_1$ and $t_3$ are equal, then $t_2$ is equal to the actual time between pulses, $t_4$, and the time of travel of the pulses and any other time loss inherent in the apparatus cancels out.

Instead of using the passage of time to measure the downhole conditions, other surface measurable conditions can be used. For example, in FIG. 2 impeller 35, equipped with blade 35*a*, is positioned in the stream of fluid pumped through the pipe string to rotate at a speed proportional to the volume of fluid pumped down the pipe string. Sensor 36 provides a pulse with the passage of each blade or with each revolution of the rotor, depending upon the frequency of pulse desired. These pulses can be used to actuate pulse motor or stepper 37 to replace chronometer or timer 15 to drive shaft 16. In this embodiment, then, the volume of fluid pumped down the pipe string during the delay before receiving a pressure signal will be indicative of the value of the downhole condition measured.

Figure 3:
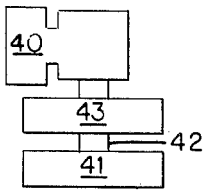
FIG. 3 is another schematic drawing of apparatus for use with the apparatus of FIG. 1, wherein the measurement of the downhole condition is determined by the number of rotations of the pipe string.

In the alternate embodiment shown in FIG. 3, timer 15 is replaced by eccentric weight 40. The weight will tend to remain stationary, if the hole is not vertical, when the drill pipe is rotated. By mounting variable resistor 41 to rotate with the pipe string, while its movable contact is rotated relative to the pipe string by eccentric weight 40 through shaft 42 and clutch 43, the number of revolutions of the drill pipe required to change the output signal of variable resistor 41 to a preselected proportional value of the signal from one of the sensors will be indicative of the measured condition. Clutch 43 functions in the same manner as described above in connection with clutch 17. A spring (not shown), such as spring 19, should be provided to return the movable contact to a known position after each measurement. Also, a gear box (not shown) may be required to be included with clutch 43 to slow down shaft 42.

Figure 4:
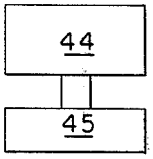
FIG. 4 is an alternate embodiment of the apparatus of FIG. 3.

In the embodiment shown in FIG. 4, instead of eccentric weight 40, gyroscope 44 is used. Again, rotation of the drill pipe is used to measure the downhole conditions with the gyroscope remaining stationary, while the pipe is rotated, causing relative movement between the movable contact of variable resistor 45 and its resistive element. The clutch and gear box, if used, is not shown, but it is understood they would function as described below.

The embodiments of the invention shown in FIGS. 1–4 have been illustrated more or less schematically since well-known components are employed that need not be described in detail. The embodiments shown in FIGS. 5*a* through 11, however, are shown in more detail to illustrate some specific structure that embodies the method and apparatus of the invention.

The embodiment of FIGS. 5*a* through 7 is designed specifically to indicate at the surface the inclination of the well bore. The apparatus will usually be used in a drilling operation. It is poitioned in drill pipe 50 at the desired location, probably adjacent the lower end of the drill pipe just above the bit, since it is the inclination of that portion of the well bore that is of particular interest to the operator. The apparatus is supported by housing 51 that includes tubular portion 52 and centrally located cylindrical instrument housing portion 53 supported on the tubular portion by radially extending spider arms 54.

Means are provided to measure the inclination of the well bore. In the embodiment shown, pendulum housing 56 is located in cavity 57 in the lower portion of instrument housing 53. The pendulum housing is mounted for rotation around the central axis of the instrument housing and the drill pipe by trunnions 58*a* and 58*b* located in axially aligned openings in partition 59 and lower end portion 60 of the instrument housing. Appropriate bearings are provided to support the pendulum housing for this rotation. The pendulum housing is designed so that its center of gravity is offset from the longitudinal axis around which it is mounted for rotation. This will cause the housing to position itself with its center of gravity on the side of the axis toward the low side of the hole.

Pendulum 61 is supported in the pendulum housing by pivot pin 62. The longitudinal axis of the pivot pin is perpendicular to a plane that extends through the center of gravity of the pendulum, the center of gravity of the pendulum housing and the axis of rotation of the housing. Thus, when the pendulum housing has positioned itself with its center of gravity adjacent the low side of the hole, pendulum 61 will swing to a position where its longitudinal axis is vertical and thus form an angle with the longitudinal axis of the drill pipe equal to the inclination of the well bore. In order for the pendulum to assume its vertical position, rotation of the drill pipe is stopped long enough for this to occur.

Means are provided to lock the pendulum in the position it assumes when the drill pipe is quiescent, to scale the angle between the longitudinal axis of the pendulum and that of the drill pipe, and to indicate this angle at the surface. In the embodiment shown, after the pendulum has been allowed to reach a vertical position, a pressure signal is supplied to passageway 64 to actuate the apparatus. This can be done with the system described in the patent application identified above. The pressure in passageway 64 will be higher than ambient pressure so that it can do work. It is supplied to cylindrical cavity 65 in the instrument housing where it acts against piston 66 to force the piston downwardly against the resilient force of coil spring 67.

The scaling means of this embodiment is moved to operative position by piston 66. The scaling means includes a cupshaped moving contact support having cylindrical portion 68*a* and disc portion 68*b*. Integrally connected to the disc portion is shaft 68*c*, which extends above and below the disc portion along the longitudinal axis of the housing. Bushing 69, located in cavity 70 below cylinder 65, supports the upper end of shaft 68*c* for rotation around its longitudinal axis. The lower end is supported for such rotation by the same opening in partition 59 that supports trunnion 58*a*. Piston rod 71 is connected to bushing 69 by flange 71*a* that is attached to the lower end of the rod and extends into an internal groove in the bushing. This allows the piston rod to move the bushing vertically with the piston, while allowing the bushing to rotate freely relative to the piston rod. The bushing is connected to shaft 68*c* by bearings 72 so that piston 66 can move the contact support vertically with the piston while allowing it to rotate relative to the bushing.

When piston 66 is moved downwardly to the position shown in FIG. 5*a*, electrical contact 73 that is mounted in the wall of cylindrical portion 68*a* of the contact carrier is moved into contact with circular resistive element 74 supported by the instrument housing. Means are provided to cause the contact to move around the resistive element to provide an output signal that varies in magnitude at a known predetermined rate. In the embodiment shown, and as best seen in FIG. 7, internal gear 75 is mounted on the inside surface of the portion of housing 53 that encircles cavity 76 in which the contact carrier is located. Gear 77, in turn, is mounted for rotation in an opening in the wall of the cylindrical portion of contact carrier 68. Gear 77 is part of a gear train made up of gears 78–82. Gear 82 is an integral part of the hub 83 that mounts eccentric weight 84 for rotation on shaft 68*c*. With all the gears in engagement, as shown in FIG. 5*a*, eccentric weight 84 will tend to remain stationary on the low side of the hole and rotation of the drill pipe will rotate outer ring gear 75. The gear train of gears 77–82 will then cause contact carrier 68 to rotate at a speed that is different than the speed of rotation of resistive element 74. The ratio of revolutions of the drill pipe to angular movement of the contact carrier relative to the resistive element is known. Thus, by counting the revolutions of the drill pipe, the distance traveled by contact 73 along resistive element 74 and the change in output signal is known. It is this arrangement that allows the angle from the vertical of pendulum 61 to be scaled and measured from the surface.

So that contact 73 will always start from the same position on the resistive element, means are provided to return the contact to a starting or index position prior to each measurement taken. In the embodiment shown, reducing the pressure in cylinder 65 allows coil spring 67 to move pistion 66 upwardly. Piston rod 71 moves with the piston and carries contact holder 68 upwardly so that gear 77 moves out of engagement with ring gear 75. In this position, the contact carrier is free to rotate. Generally flat coil spring 85 has one end connected to the instrument housing by pin 86 and the other end connected to contact carrier by pin 87. The spring is arranged to rotate the housing until a stop lug (not shown) on the contact carrier engages a stop lug (not shown) on the housing to stop further rotation and to return the contact in a known position relative to resistive element 74.

Then, when it is desired to scale the angle of inclination of the well bore, the apparatus is actuated by pressure being supplied to chamber 65. Piston 66 moves the contact carrier downwardly, moving the contact into engagement with the resistive element and the gear train into engagement with ring gear 75. This downward movement also causes disc 88 carried by shaft 68*c* to move brushes 89 and 90 into contact with slip rings 91 and 92 carried by pendulum housing 56. The brushes are mounted in partition 59 for limited vertical movement. Coil springs (not shown) urge the brushes away from slip rings 91 and 92 so they will not be in contact when the apparatus is not in operation. The brushes are electrically insulated from the housing and disc 88 is made of electrically non-conducting material. The brushes are used to supply electrical power to the pendulum housing and to connect its output signal into the comparator circuit, as described below. When the disc moves the brushes into engagement with the slip rings, current is supplied to solenoid 93 on the pendulum. The solenoid moves lock pin 94 into engagement with rack 95 to lock the pendulum against further pivotal movement around the axis of pivot pin 62. Before the apparatus is actuated, of course, movement of the pipe was stopped to allow the pendulum to seek a vertical position. The solenoid also moves contact 96 into engagement with resistive element 97 (FIG. 6). A circuit (not shown) is designed so that the position of contact 96 on resistive element 97 will produce a signal proportional to the angle between the vertical axis of the pendulum and that of the longitudinal axis of the drill pipe in the well bore. This signal is supplied to one leg of a circuit, such as a Wheatstone bridge, that will act as a comparator between this signal and the varying signal to be received from the movement of contact 73 along resistive element 74.

To readout the inclination at the surface, pressure continues to be applied against piston 66 to hold contact 73 in engagement with element 74 and gear 77 in engagement with ring gear 75. Fluid, of course, continues to be pumped through the drill pipe to provide this pressure. Rotation of the drill pipe is started to move contact 73 along resistive element 74 until the comparison circuit determines that the output signal from the leg of the circuit that includes resistive element 74 and contact 73, provides a signal having a preselected proportional value with respect to the signal proportional to the inclination that is provided by the circuit containing contact 96 and resistive element 97. When these two signals reach this preselected proportional relationship, solenoid 98 is actuated, which causes a pressure pulse to be created in the fluid being pumped down the drill pipe that can be detected at the surface. The number of revolutions of the drill pipe that occurred before such signal is received will indicate at the surface the value of the signal from the pendulum circuit from which the angle of inclination of the well bore can be determined.

The surface signal is produced in the embodiment shown in FIG. 5*a* as follows: A section of decreased internal diameter of tubular portion 52 of the housing creates orifice 100. Located on the upper cylindrical portion 53 of the housing is piston 101 having cylindrical skirt 102 that extends downwardly over the outside of cylindrical portion 53. This provides cylindrical chamber 103 to receive fluid under pressure to act against piston 101 and move it upwardly. The piston carries valve member 104 that can move axially relative to the piston a distance limited by pin 105. This movement is provided to allow the valve member to move upwardly opening ports 106 through the piston to allow reverse circulation of fluid when desired. When in the down position, as shown, the valve member closes off the flow of fluid through ports 106.

Spring 107 urges the piston and valve member into position to restrict the flow through orifice 100. The spring is designed to insure that there is a pressure drop across the orifice at all times. Upstream of the orifice, fluid at upstream pressure is supplied to passageway 108 which leads to chamber 103. When solenoid 98 is not energized, it keeps passageway 108 closed to the chamber by valve member 98*a*. When energized, which as described above is at the time the two signals reach a preselected proportional relationship, passageway 108 is opened to chamber 103. This allows fluid at upstream pressure to act against piston 101 and move it upwardly restricting the flow through orifice 100 sufficiently to cause a pressure pulse that can be recorded at the surface.

In the embodiment described and shown in FIG. 5*a*, eccentric weight 84 was employed to hold gear 82 stationary as the drill pipe was rotated. If the well bore happened to be substantially vertical, the ability of the eccentric weight to do this would be greatly reduced. Since this readout or scaling mechanism may be used to measure downhole conditions other than the inclination of the well bore, the embodiment of FIG. 8 is provided to allow such measurements to be made even in a vertical hole.

Bushing 110 is the equivalent of bushing 69 of FIG. 5*a*. It is connected in the same manner to piston rod 71 and is moved up and down by piston 66. Carried by bushing 110 is disc 111 that can rotate relative to the bushing. This disc carries the movable contact and supports the gear train in the same manner as contact carrier 68 of FIG. 5*a*. Gyroscope 112 is connected to gear 113 which is the equivalent of gear 82 of FIG. 7. When contact bearing plate 111 is moved downwardly, gyro 112 moves into engagement with contacts 114 and electrical energy is supplied to the gyro to spin the gyro up by the internal motor of the gyro. When this is done, the gyro will remain substantially motionless and, in turn, hold gear 113 stationary while the drill pipe is rotated to measure a downhole condition.

It is another feature of this invention to provide apparatus for measuring the aximuthal direction of a well bore. In FIG. 9, housing 120 is of non-magnetic material. Compass housing 121 is mounted for rotation around axis 122 in chamber 123 of the housing. Axis 122 coincides with the longitudinal axis of the drill pipe in which this instrument is positioned. The compass housing is designed so that its center of gravity is well to one side of the axis of rotation 122. This will cause the compass housing to position itself with its center of gravity toward the low side of the well bore. Compass needle 124 is supported by shaft 125 in the compass housing and is free to rotate to orient itself with respect to the earth's magnetic field. The needle is disc-shaped in this embodiment and carries arcuate resistive element 126 on one side and arcuate contact 127 on the other. When desired, pressure can be supplied through passageway 130 to move lock pin 129 into opening 131*a* of end plate portion 131 to lock the compass housing against movement. The compass, then, will measure the azimuthal relationship between a housing index and north.

When it is desired to measure the azimuthal or compass direction of a well bore, the compass housing is allowed to seek the low side of the hole. Pressure is then supplied to chamber 132 through passageway 133. This causes piston 134 to move rod 134*a* into engagement with the end of trunnion 135 that supports the lower end of the compass for rotation. Sufficient friction is provided between the piston rod and the end of the trunnion for the piston to hold the housing against rotation relative thereto. The movement of the piston also moves pin contact 136 upwardly into electrical contact with contact ring 137. This supplies electrical energy to the circuitry in the compass housing.

When pressure fluid is supplied to cylinder 132 to move piston 134, it also travels through the opening in the piston into chambers 138 and 139 in the compass housing. This pressure moves contacts 140 and 141 into engagement with resistive element 126 and contact ring 127, respectively.

The output signal from this device is determined by the angular distance between the point that contact 140 engages the resistive element and a selected point related to magnetic north. This can be scaled using the comparative circuit described above and rotation of the drill pipe. If, for example, the signal produced at the surface indicates that there were 180° between the contact point on 126 and, say the index point is north on the compass element, then the indication would be that the well bore is progressing in a northerly direction, since the low side of the hole is positioned 180° from north. If the angular distance measured was 60°, then it would be known that the hole is progressing in an azimuthal direction of 240° from north.

FIGS. 10 and 11 illustrate apparatus for measuring the temperature of the fluid adjacent the bottom of the well bore so that it can be scaled with the apparatus and method of this invention. In the embodiment shown, a temperature sensitive, bimetallic element 150 is formed into a spiral. The inner end of the element is anchored to portion 151 of the instrument housing. Its outer end carries electrical contact 152. This contact moves along resistive element 153. As the temperature varies, of course, the bimetallic material will cause contact 152 to change its position relative to resistive element 153. When it is desired to measure the downhole temperature, ground plate 154 is moved into engagement with contact 152 by piston 66 or a similar arrangement, completing the circuit to provide a signal that is proportional to the temperature being measured. This signal is then compared to a signal that changes in magnitude at a known rate with respect to the revolutions of the drill pipe to produce a pressure pulse in the manner described above that is detectable at the surface to indicate downhole temperature.

Since the range of temperatures to be measured can be estimated, the instrument is preferably calibrated to measure temperatures in the expected range. This will improve the accuracy of the measurement. In other words, if every revolution of the drill pipe equals 1° of temperature, if you started at 200° and the temperature happened to be 250°, then 50 revolutions of the drill pipe would produce the pressure pulse. Whereas, starting at 0° and using 1° per revolution, 250° would require 250 revolutions of the drill pipe which would be time consuming and unnecessary.

Power is required for operating the electrical equipment employed with this apparatus. A battery can be used, but batteries lose their charge over a period of time. In accordance with one feature of this invention, means are provided to supply a charging current to a battery. In the embodiment shown in FIG. 5*a*, the energy in the drilling fluid being pumped down the drill pipe is used to rotate impeller 160. The impeller drives generator 161 to provide recharging current to battery 162. Whatever voltage regulators are required would be housed in this lower end of the housing also. Instead of a generator, of course, an alternator could be used for this purpose.

Apparatus for practicing the method of this invention that is completely hydraulic is shown in FIG. 13. This apparatus is shown mounted in instrument housing 200 for locating in a pipe string. To better show the components, the upper end of the instrument housing is shown on one scale and the lower end on a much larger scale.

The upper portion of the housing includes flow restriction 210 forming orifice 202 through which fluid pumped through the pipe string must flow. Actuating pressure is supplied to the apparatus through passageway 203. Valve 205 is moved upwardly to create a surface detectable pressure pulse when pressure from upstream of orifice 201 is supplied to chamber 204 through passageway 229.

The flow of upstream pressure fluid through passageway 229 is controlled by two valves. Valve element 213*a* is attached to piston 213. Spring 213*b* holds the valve element in position to close the passageway when no other forces are exerted on piston 213. The downstream of this valve, valve element 207*a*, is attached to piston 207 for controlling flow through passageway 229. Spring 207*b* urges piston 207 downwardly, as shown in FIG. 13, which will maintain this valve open unless the piston is acted on by a force sufficient to overcome the spring force.

Actuating pressure in passageway 203 acts against piston 213 to open this valve. Piston 207, under the force of spring 207*b*, will maintain valve element 207*a* away from its seat so that when valve element 213*a* is moved to allow the flow of fluid through the passageway, it can flow directly into chamber 204 and move valve chamber 205 upwardly into orifice 202 and create a pressure pulse in the fluid being pumped down the drill pipe. In this apparatus, then, a pressure pulse is sent to the surface when the apparatus is initially actuated. At the same time the actuating pressure is opening valve 213, it flows through selector valve 212 into one of several ports that are connected to measuring devices. As shown, the actuating pressure fluid flows through passageway 216 to chamber 228 in the lower portion of the housing.

The measuring device or sensor shown in one to measure inclination of the well bore. It includes pendulum 217 that is supported by ball 219 for universal movement. The pendulum has a conically-shaped opening that is grooved to provide a series of annular notches 225. Extending into the opening in the pendulum is plunger 224 that extends upwardly from chamber 228 through chamber 222 into the opening of the pendulum. Piston 221 is connected to the plunger and is urged upwardly by coil spring 222*a*. Coil spring 223 in chamber 228 acts against piston 226 that slides on the plunger and urges the plunger downwardly. Before the readout operation is started, movement of the pipe is stopped to allow pendulum 217 to seek a vertical position. Then, when the actuating pressure, as described above, reaches chamber 228, plunger 224 will be all the way down to the lower end of its travel since spring 223 is much stronger than spring 222*a*. The actuating pressure acts against piston 226 and compresses spring 223 to the position shown in FIG. 13. The pressure also acts against the end of plunger 224 urging it upwardly along with the force of spring 222*a*. The fluid in chamber 222, however, must be displaced by piston 221 through passageway 220, which restricts the flow of this fluid from the chamber so that a period of time will be required for the plunger to travel to the position shown. As soon as the actuating fluid begins to exert a force on plunger 226, there will be a pressure created in passageway 220 due to the upward movement of piston 221 trying to displace the fluid from the chamber. Passageway 220 is connected to passageway 209 so that the pressure created in this passageway by piston 221 will be transmitted through check valve 208 to act against piston 207 and cause the piston to move upwardly in valve element 207*a* to close passageway 229. Valve element 205, then, will move downwardly out of its pressure pulse creating position as long as there is pressure exerted against piston 207. This pressure will continue until the upper end of plunger 224 engages one of the annular grooves of the inside of pendulum 217. As shown, the plunger has moved through its maximum possible stroke, and this is the stroke that would occur when the hole or the well bore is vertical and the longitudinal axis of the pendulum coincides with the longitudinal axis of the well bore. This will be, of course, also the longest period of time from the receipt of the initial pressure pulse until the receipt of the second which occurs when plunger 224 is stopped in its upward travel by the pendulum. When the plunger is stopped, the pressure in passageways 220 and 209 will drop quickly allowing piston 207 to be moved downwardly by spring 207*b*, opening up passageway 229. This will cause valve element 205 to again move up toward orifice 202 and create a second pressure pulse.

The speed of travel of plunger 224 is predetermined by the design of the springs and the areas involved, the pressure drop through the passageways, and the actuating pressure. Thus, the length of time between pulses can be correlated to degrees or partial degrees of inclination of the pendulum and, in turn, the well bore.

Actuating pressure, when supplied, also locks the penulum in the position it has assumed when the pipe was quiescient. This is done by piston clamp 218 that is moved downwardly into engagement with ball 219 by pressure supplied through passageway 214 from the actuating pressure source. Valve 213*a* will remain open as long as actuating pressure signal remains in passageway 203. When the second pressure signal is created by valve element 205, upstream pressure will rise sharply. This will be reflected in passageway 229 and spring loaded check valve 230 is designed to open under the force of this peak pressure. It is, therefore, connected to passageway 229 so that when the peak pressure of the pressure pulse is created, pressure will be supplied to piston 211 which actuates selector valve 212, switching the valve to the next passageway 215 connected to the next sensor to be read out. This sensor will have its own dashpot arrangement, such as that described above in connection with pistion 221 and passageway 220, that will supply pressure through one of the check valves 208 to supply fluid to close valve 207*a* in the manner described above to provide a time period delay between pulses that is indicative of the measurement of the downhole condition by the sensor.

FIG. 14 is apparatus for use in indicating the azimuthal direction of a well bore. Plunger 224a is the equivalent of plunger 224 described above. Instead of engaging the conically-shaped grooved opening of the pendulum, however, it engages cam surface 250 on the bottom of eccentric weight member 251, which is mounted for rotation by shaft 252. In any convenient manner, plunger 224a is arranged to have a known relationship to the tool reference line. The cam surface, then, will allow the plunger to move different distances, depending upon the angular position of the low side of the hole with respect to orientation of the tool reference line. Piston 253 is moved into engagement with brake disc 254 to hold the elements in position until a readout can be finished. Piston 253 is actuated by actuating pressure through passageway 255.

FIGS. 15 through 17 show another embodiment of the apparatus of this invention that practices the method of the invention employing electrical circuitry. In FIG. 15, the operation of the apparatus is shown schematically. Basically, sensor 231 measures the downhole condition to be measured when actuated by pressure switch 235 that receives pressure signals from above through passageway 238. Delay 232 provides a delay proportionate to the measurement read by the downhole sensor. After this delay, the signal is transmitted through stepper switch 233 to delay 234, which actuates solenoid 235. Delay 224 does not delay the operation of the solenoid, but is more a holding delay to hold the solenoid in position to hold valve 237 open and allow valve element 241 to be moved upwardly and create a pressure pulse. The time involved here will be fixed so that it will not enter into the measurements at the surface.

The circuit for this is shown in FIG. 16. Assume sensor 231 includes a potentiometer having moving contact 231a. Initially, switch $S_2$ is closed and when the apparatus is actuated power will be supplied through resistance R and, depending upon the position of contact 231a, a voltage will be impressed across $C_1$ and $R_1$ through closed switch $S_2$. Voltage will build up on $C_1$ at a predetermined rate, the $S_2$ field being energized at the same time, but actuation of this relay is delayed by $R_2$ and $C_2$. When relay $S_2$ is actuated, the switch is open. Voltage is no longer impressed across $C_1$, and the $C_1$ energy begins to drain off. When the charge on $C_1$ drops to a value (*u* in FIG. 17) which is preselected, $S_1$ will drop out. This is a normally closed switch, but is opened by the energy that charges $C_1$ before $S_2$ opens. The time lapse between the opening of $S_2$ and the closing of $S_1$ is proportional to the voltage (V) delivered by sensor 231. Each sensor could have its own delay circuit, depending upon circumstances, or possibly one delay circuit could be used for all sensors. Stepping 233 simply serves to switch between sensors and if the same delay is to be used for each sensor, then, of course, the stepper would have to be positioned between the delay and the sensor. Timer 234, as explained above, simply insures that when $S_1$ drops out energizing solenoid 235, the solenoid will be energized long enough to insure a good strong pressure pulse to the surface. This is shown in the circuit as capacitor $C_3$ that will store sufficient energy to accomplish this.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, what is claimed is:

1. A method of indicating at the earth surface the measurement of a condition in an earth borehole in which a pipe string is situated comprising the steps of; measuring the condition, sending a signal to the surface after a delay that is proportional to the measurement and measuring the delay in terms of the amount of movement of at least one material moving within the pipe string outer surface envelope.

2. The method of claim 1 in which the material is fluid moving in the pipe string bore.

3. The method of claim 1 in which the movement is revolutions of the pipe string.

4. A method of indicating at the earth surface the evaluation of a condition in an earth borehole with a pipe string positioned therein comprising the steps of; providing a first signal having a characteristic proportional to the measurement of the condition, sending a second signal to the surface after a delay that is proportional to the characteristic and synchronizing the surface and downhole delay measurements by movement of materials within the pipe string outer surface envelope.

5. A method of indicating at the surface the measurement of a downhole condition comprising displacing fluid from a container through a flow-restriction at a known rate, measuring the downhole condition, limting the displacement of fluid to an amount proportional to the measurement, and sending a signal to the surface when said amount has been displaced.

6. Apparatus carried by a pipe string for indicating at the earth surface the measurement of an earth borehole condition comprising; means for measuring the condition, means for transmitting a signal to the surface, means to detect movement of materials within the pipe string outer surface envelope, and means responsive to said measuring means and to said detecting means for delaying the transmission of the signal until an amount of movement is detected that is proportional to the measurement.

7. The apparatus of claim 6 in which the movement is revolutions of the pipe string.

8. The apparatus of claim 7 in which the delaying means includes means providing a first signal having a characteristic that varies at a known rate per revolution of the pipe string, means providing a second signal having a characteristic with a magnitude that is proportional to the measurement of the condition and means to compare the first and second signals to actuate the surface detectable signal when the varying characteistic of the first signal reaches a predetermined proportionate amount of the second signal.

9. The apparatus of claim 6 in which the movement is fluid moving through the pipe string bore.

10. The apparatus of claim 9 in which the delaying means includes means providing a first signal having a characteristic that varies at a known rate per unit volume of fluid moving in the pipe string, means providing a second signal having a characteristic with a magnitude that is proportional to the measurement of the condition and means to compare the first and second signals to actuate the surface detectable signal when the varying characteristic of the first signal reaches a predetermined proportionate amount of the second signal.

11. A method of indicaing at the earth surface the measurement of a condition in an earth borehole in which a pipe string is situated comprising the steps of; providing a first signal that changes from a known value at a surface measureable rate proportional to the rate of movement of material within the pipe string outer surface envelope, providing a second signal proportional to the value of the condition, comparing the first and second signals, and sending a signal to the surface when the two signals reach a preselected relationship to indicate at the surface the measurement of the condition.

12. The method of claim 11 in which the movement is rotation of the pipe string.

13. The method of claim 11 in which the first signal changes value at a predetermined rate with respect to the flow rate of fluid moving through the pipe string.

14. Apparatus for measuring from the earth surface a condition in an earth borehole with a pipe string positoned therein comprising; means providing a first signal that changes in value from a known amount at a rate proportional to the rate of movement of materials within the pipe string outer surface envelope, means providing a second signal proportional to the condition to be measured, means for comparing the two signals, and means for creating a surface detectable signal when the two signals have a preselected relationship to indicate at the surface the measurement of the condition.

15. The apparatus of claim 14 in which the means for providing the first signal includes means for changing the value of the first signal at a given amount for each revolution of the drill string.

16. The apparatus of claim 14 in which the means for providing the first signal includes means for changing the value of the first signal at a rate proportional to the rate of movement of fluid through the drill string.

17. Apparatus for measuring from the surface a downhole condition in a well bore with a pipe string positioned therein, comprising sensor means having a movable element that will assume a position responsive to the measurement of the downhole condition, means providing a first signal that changes at a known rate from a preselected original value, means responsive to the position of the movable element providing a second signal proportional to the value of the downhole condition, means for comparing the two signals, and means for sending a signal to the surface when the two signals reach a preselected relationship.

18. The apparatus of claim 17 in which the movable element is a pendulum and the sensor includes means mounting the pendulum to pivot around a horizontal axis so that the pendulum will swing to the low side of the well bore and assume an angle with the axis of the pipe string equal to the inclination thereof.

19. The apparatus of claim 18 in which the means providing the second signal includes an electrical circuit having a resistive element and contact means carried by the pendulum in engagement with the resistive element and movable along the element to cause the signal provided by the circuit to be proportional to the angle between the pendulum and the longitudinal axis of the pipe string.

20. The apparatus of claim 17 in which the movable element is a compass needle and the condition measured is the azimuthal direction in which the pipe string extends.

21. The apparatus of claim 17 in which the movable element moves in response to variations in temperature.

* * * * *